US005779078A

United States Patent [19]

Reddy

[11] Patent Number: 5,779,078

[45] Date of Patent: Jul. 14, 1998

[54] INTERMODAL CONTAINER TANK CONSTRUCTION

[76] Inventor: Neil Reddy, 2301 S. Millbend Dr. (Apt. 1102), The Woodlands, Tex. 77380

[21] Appl. No.: 749,347

[22] Filed: Nov. 21, 1996

[51] Int. Cl.[6] ..... B65D 88/08

[52] U.S. Cl. ..... 220/1.5; 220/562; 220/4.12; 220/401; 220/668

[58] Field of Search ..... 220/1.5, 4.12, 220/562, 401, 628, 668

[56] References Cited

U.S. PATENT DOCUMENTS

| | | | |
|---|---|---|---|
| 3,616,959 | 11/1971 | Remsey | 220/401 |
| 4,065,022 | 12/1977 | Cainaud | 220/1.5 |
| 4,307,812 | 12/1981 | Gerhard | 220/1.5 |
| 4,354,612 | 10/1982 | Pelabon | 220/401 |
| 4,416,384 | 11/1983 | Bjurling | 220/1.5 |
| 4,593,832 | 6/1986 | Gerhard | 220/1.5 |
| 5,083,673 | 1/1992 | Fossey | 220/1.5 |
| 5,390,806 | 2/1995 | Elston et al. | 220/1.5 |

FOREIGN PATENT DOCUMENTS

| | | | |
|---|---|---|---|
| 2 900 419 | 7/1980 | Germany | 220/401 |
| 2 013 624 | 8/1979 | United Kingdom | 220/401 |

*Primary Examiner*—Stephen J. Castellano
*Attorney, Agent, or Firm*—Bucknam and Archer

[57] ABSTRACT

There is provided an intermodal container tank construction wherein the tank vessel is connected to and supported on the respective structural end frames by respective connecting systems. Each connecting system includes a space frame structure interconnecting a circumferential ring stiffener positioned near a tank vessel end to a respective end frame. The space frame structure includes left and right vertical trusses connecting the left and right sides of the end frame to the respective lateral sides of the ring stiffener and top and bottom horizontal trusses connecting the top and bottom of the end frame to the respective top and bottom of the ring stiffener. The trusses transfer all vertical and horizontal loads on the tank vessel to the corner fittings of the front and rear end frames.

30 Claims, 11 Drawing Sheets

INTERMODAL CONTAINER TANK CONSTRUCTION

The present invention relates generally to intermodal container tanks such as employed in land, sea and air transportation of bulk liquids and other bulk materials with fluid like characteristics and, more particularly, it relates to an improved construction for such container tanks which is more efficient than intermodal container tank constructions employed heretofor.

Intermodal container tanks generally consist of two types, namely, the full frame type and the beam type. The frame type intermodal container tank comprises a generally cylindrically shaped tank closed by end caps which are generally convexly shaped and vertical, transversely arranged rectangular end frames which are interconnected by longitudinal structural members so as to provide structural integrity for the container tank. The tank itself may be securely supported within this frame structure by means of cradles or saddles and/or other bearer members in order to transfer the container tank load to the frame structure. Examples of such frame type container tanks can be found in U.S. Pat. No. 4,354,612, to Pelabon, granted Oct. 19, 1982 and U.S. Pat. No. 4,416,384, to Bjurling, granted Nov. 22, 1983.

In the beam type intermodal container tank, the tank itself serves as a structural member connecting the structural end frames. The end frames are themselves connected to the tank by means of structural bearer members which transfer the container tank load to the end frames. As in the case of the frame type container tank, the tank of the beam type is generally cylindrically shaped having its ends closed by generally convexly shaped end caps. The end frames are vertical, transversely arranged rectangular structures dimensioned to be approximately equal to the tank diameter or slightly larger.

An example of a beam type intermodal container tank can be found in U.S. Pat. No. 5,083,673, to Fossey, granted Jan. 28, 1992. The Fossey patent discloses a tank vessel which is connected to each of its respective rectangular end frames by mounting means comprising two upper and two lower bearer members arranged at a 90° interval with respect to each other and at 45° with respect to a vertical line passing through the tank diameter. In one embodiment, all four bearer members are identical and consist of a bearer plate extending longitudinally from tank to end frame, being curved at the tank connection to conform to the tank curvature and welded thereto adjacent to the weld seam of the end cap, i.e. the head knuckle radius. At the end frame, the bearer plate is welded to a corner connecting member which extends between a frame side member and the adjacent cross member. In another embodiment, one which is used commercially, the lower bearer members each comprise a generally triangularly shaped boxed section arranged radially with respect to the tank and connected to the tank at about the head knuckle radius through supporting side flanges welded to the tank. The bearer member is then connected to the end frame between the middle of the corner connecting member and the respective corner of the end frame.

Intermodal container tanks are designed and fabricated to meet recognized standards, such as promulgated by the International Organization for Standardization (ISO), U.S. Department of Transportation (D.O.T.), International Maritime organization (IMO), American Society of Mechanical Engineers (ASME) and similar organizational bodies. Specifically, the U.S. D.O.T. regulations limit the maximum gross weight of such container tanks transported over U.S. highways. Thus, the unladen weight or tare weight of the intermodal container tank is an important factor affecting the amount of material which can be shipped in the container tank. Intermodal container tank constructions heretofor employed result in container tanks which are unnecessarily heavy because of structural considerations relating to the tank to frame connection methods used. This added tare weight reduces the allowable cargo weight while increasing handling and transportation costs.

Furthermore, especially in connection with beam type intermodal container tank constructions, as typified by the hereinabove described Fossey patent, the structural bearer members connecting the lower part of the tank to the structural end frames are relatively rigid because of the geometric shapes required for the connections. Thus, since such bearer members are generally attached to the tank proper in the immediate area of the head knuckle radius, the relative rigidity of the bearer members and the relatively thin plate of the tank vessel result in additional stresses being introduced into the thin plate of the tank and its head or end cap at the critical head knuckle radius.

Yet another disadvantage inherent in intermodal container tank constructions employed heretofor relates to structural damage sustained by the structural bearer members and end frames during handling. Any such structural damage requires that the container tank be taken out-of service for a substantial period of time so that repairs can be effected at a qualified repair shop. In addition, fabrication of current intermodal container tanks is, in many cases, difficult and inefficient because of the complex and often ponderous designs employed, thus requiring added fabrication labor which is reflected in the cost of the container tanks.

It is, therefore, a primary object of the present invention to provide an intermodal container tank construction, particularly of the beam type container tank, which results in an intermodal container tank which has a lighter tare weight, minimizes stresses in the tank shell, employs a simple design and can be more easily repaired than intermodal container tanks heretofor.

The above object, as well as others, which will hereinafter become apparent, is accomplished in accordance with the present invention by the provision of a novel tank to end frame connection system which employs a truss framework connected between the extreme circumferential ring stiffener nearest each tank end and the respective structural end frame. Circumferential ring stiffeners are required for most if not all intermodal container tank constructions to compensate for any negative internal tank pressures resulting from an external over pressure. By connecting the truss framework to the required circumferential ring stiffeners rather than directly to the tank, the tank forces resulting from tank and cargo weights and acceleration forces during transit bypass the tank proper and are transmitted directly to the extreme circumferential ring stiffeners and thence through the truss framework to the support points in the structural end frames. Thus, additional stresses resulting from out-of-plane bending on the already stressed tank proper, especially in the head knuckle radius, near the welded connection of the tank end to the tank shell, are minimized.

The truss framework, which efficiently transmits tank loads to the end frames, consists of eight bearer members connected to each end frame and arranged in pairs to surround the tank proper on its four longitudinal sides, left, right, top and bottom. Each pair of truss members is connected to a longitudinal side of the extreme circumferential ring stiffener at a common point and each truss member runs therefrom at substantially a 45° angle to the respective vertical or horizontal column of the end frame, which also constitute truss members, and attaches thereto near the corner casting or fitting. A truss member is designed to carry axial loads so that the entire cross-sectional area of the member is either in tension or compression. Thus, the load paths for loads transmitted by the tank to the end frames are as follows: longitudinal tank loads are transmitted to the end frames by all the truss members connected to the tank; vertical tank loads are transmitted to the end frames by the truss members connected to the tank in the two vertical longitudinal planes, i.e. left and right sides, of the tank (the truss members connected to the tank in the two horizontal longitudinal planes, i.e top and bottom, of the tank are ineffective for vertical loads); transverse tank loads are transmitted to the end frames by the truss members connected to the tank in the two horizontal longitudinal planes, i.e. top and bottom of the tank (the truss members connected to the tank in the two vertical longitudinal planes, i.e. left and right sides of the tank are ineffective for transverse loads).

In another embodiment of the present invention, the truss framework of eight bearer members are connected in pairs at a common point on the circumferential ring stiffener at 45° to the vertical and horizontal diametric planes of the tank and extend therefrom at substantially a 45° angle to substantially the centers of adjacent horizontal and vertical columns of the respective end frame. In this embodiment, the adjacent one half of the horizontal and vertical columns of the end frame in effect constitute the remaining truss member of each truss.

Other objects and features of the present invention will become apparent from the following detailed description considered in connection with the accompanying drawings, in which.

Figure 1:
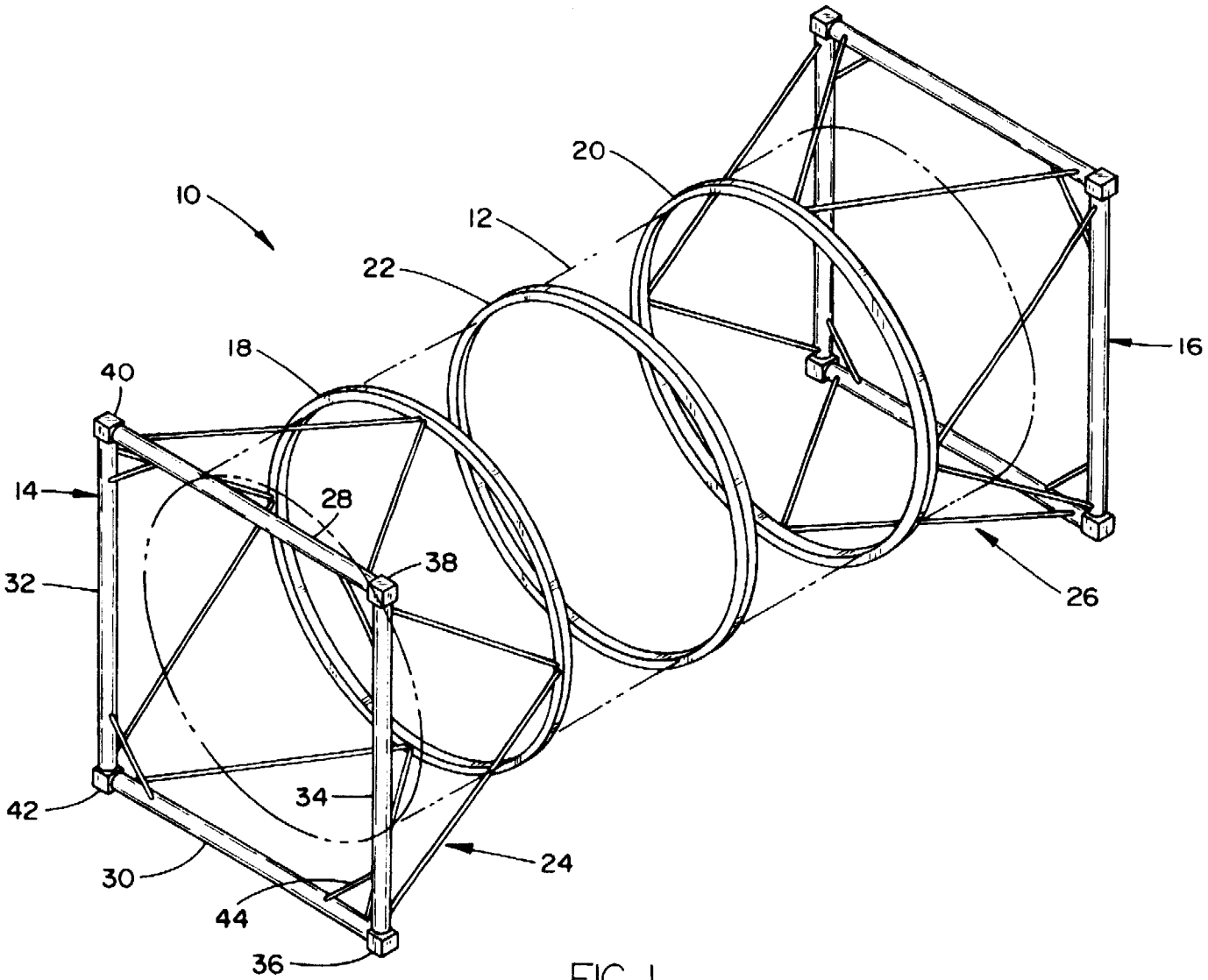
FIG. 1 is a perspective view of an intermodal container tank constructed in accordance with the present invention.

Now turning to the drawings, there is shown in FIG. 1 a beam type intermodal container tank, generally designated 10, including a generally cylindrically shaped tank vessel (shown in phantom for purposes of clarity), designated 12, a rear structural end frame, designated 14, a substantially identical opposing front structural end frame, designated 16, a rear circumferential stiffening ring, designated 18, a front circumferential stiffening ring, designated 20, at least one intermediate circumferential stiffening ring, designated 22, a rear connecting system 24 connecting rear end frame 14 to tank 12 and a front connecting system 26 connecting front end frame 16 to tank 12.

Rear structural end frame 14 is disposed near to the rear or discharge end of tank 12 and includes horizontal top and bottom rails, respectively designated 28 and 30, vertical left and right corner posts, respectively designated 32 and 34, four identical corner fittings, designated 36, 38, 40 and 42, respectively, and four identical diagonal corner braces 44. Front structural end frame 16 is substantially identical to rear end frame 14 and disposed near to the front end of tank 12. Commonly, a structural end frame, such as end frames 14 and 16 herein, is dimensioned slightly larger than the tank it is connected to in order to protect the adjacent tank head or end and the tank vessel itself. The corner fittings are standardized throughout the industry and permit the stacking of a plurality of intermodal container tanks for shipping purposes and the handling of such tanks by specialized equipment.

Rear circumferential stiffening ring 18 is identical to front circumferential stiffening ring 20 and consists of a metal channel welded to the exterior of tank vessel 12 for structural support and strengthening of the shell of tank 12. One or a plurality of similarly constructed intermediate circumferential stiffening rings 22 may be arranged on tank 12 between front and rear stiffening rings 20 and 18. Rear stiffening ring 18 is positioned on tank 12 near the welded connection of the tank head or end to the tank itself. Front stiffening ring 20 is similarly positioned at the opposing end of tank 12.

Figure 2:
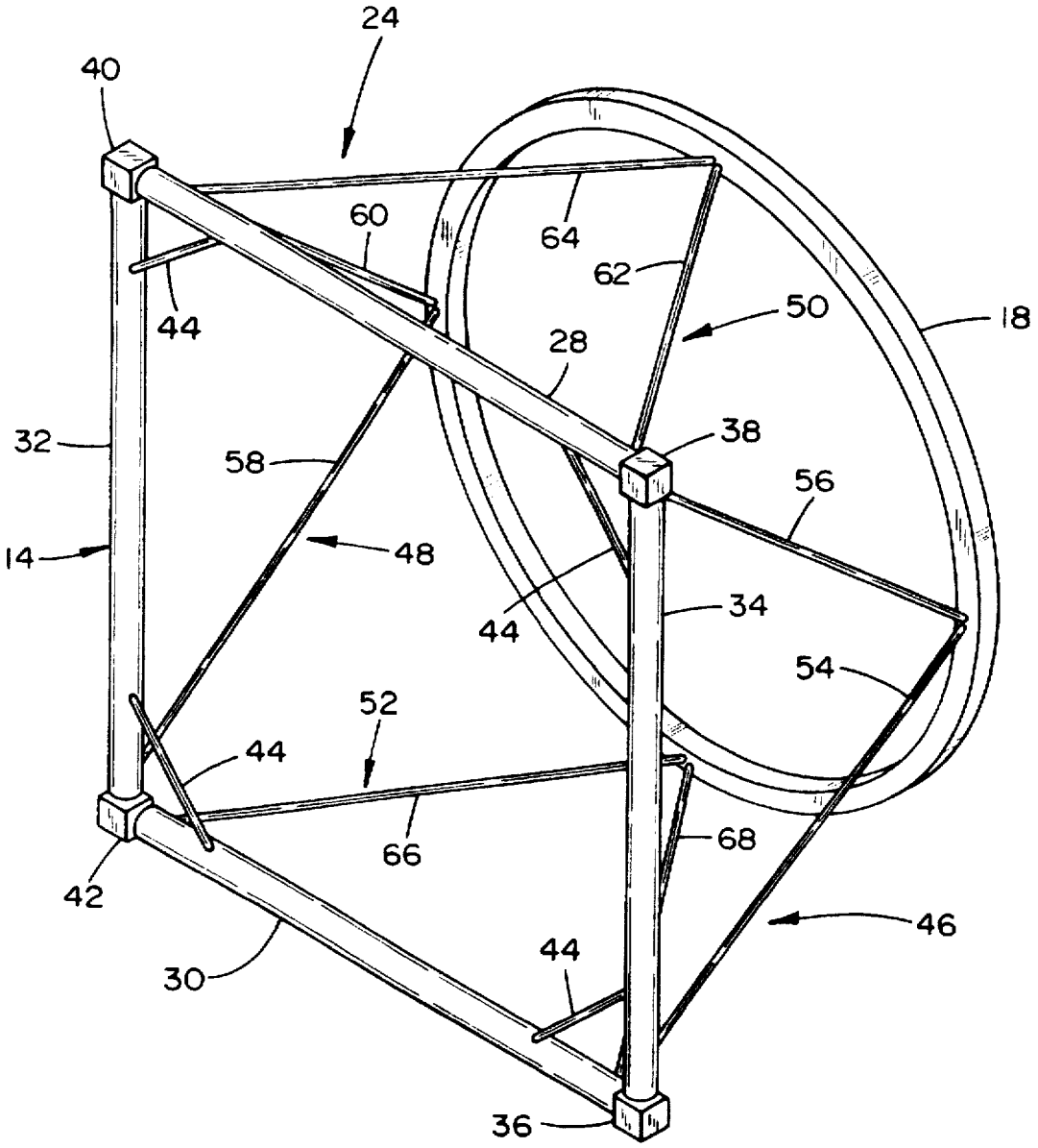
FIG. 2 is a perspective view of one of the intermodal container tank structural end frames and tank to end frame connection system shown in FIG. 1.

Rear connecting system 24 is substantially identical to front connecting system 26 and, as clearly seen in FIG. 2, interconnects end frame 14 and rear stiffening ring 18. Novel front and rear connecting systems 26 and 24 are constituted to fully structurally support tank 12 on end frames 14 and 16 without the need for additional structural supporting elements. Connecting system 24 consists essentially of a space frame structure wherein right vertical truss 46 connects the right side of end frame 14 to the right lateral side of stiffening ring 18, left vertical truss 48 connects the left side of end frame 14 to the left lateral side of stiffening ring 18, top horizontal truss 50 connects the top of end frame 14 to the top of stiffening ring 18 and bottom horizontal truss 52 connects the bottom of end frame 14 to the bottom of stiffening ring 18. Right vertical truss 46 consists of a member 54 connected to corner post 34 at the bottom thereof near bottom corner fitting 36 and a member 56 connected to corner post 34 at the top thereof near top corner fitting 38. Thus, corner post 34 also forms one of the truss members of right vertical truss 46. Truss members 54 and 56 run upwardly and downwardly, respectively, from corner post 34 at an approximately 45° angle to converge and meet at the right lateral side at about the center of stiffening ring 18. Left vertical truss 48 consists of a member 58 connected to corner post 32 at the bottom thereof near bottom corner fitting 42 and a member 60 connected to corner post 32 at the top therof near top corner fitting 40. Thus, corner post 32 also forms one of the truss members of left vertical truss 48. Truss members 58 and 60 run upwardly and downwardly, respectively, from corner post 32 at an approximately 45° angle to converge and meet at the left lateral side at about the center of stiffening ring 18. Top horizontal truss 50 consists of a member 62 connected to horizontal top rail 28 at the right side thereof near top corner fitting 38 and a member 64 connected to horizontal top rail 28 at the left side thereof near top corner fitting 40. Thus, horizontal top rail 28 forms one of the truss members of top horizontal truss 50. Truss members 62 and 64 run from the respective sides of horizontal top rail 28 at an approximately 45° angle to converge and meet at about the center of the top of stiffening ring 18. Bottom horizontal truss 52 consists of a member 66 connected to horizontal bottom rail 30 at the left side thereof near bottom corner fitting 42 and a member 68 connected to horizontal bottom rail 30 at the right side thereof near bottom corner fitting 36. Thus, horizontal bottom rail 30 forms one of the truss membes of bottom horizontal truss 52. Truss members 66 and 68 run from the respective sides of horizontal bottom rail 30 at an approximately 45° angle to converge and meet at about the center of the bottom of stiffening ring 18.

The space frame connecting system hereinabove described, connecting the end frames to the respective stiffening rings, effectively transfers all horizontal and vertical tank loads to the end frame and thus the corner fittings which support the intermodal container tank during shipping and handling. Furthermore, in the event of damage to one or more of the truss members of the space frame connecting system, resulting from collisions or other accidents, it is a relatively easy matter to replace the damaged truss member which, in many cases can be accomplished on site without removal of the container tank to a repair shop.

Figure 3:
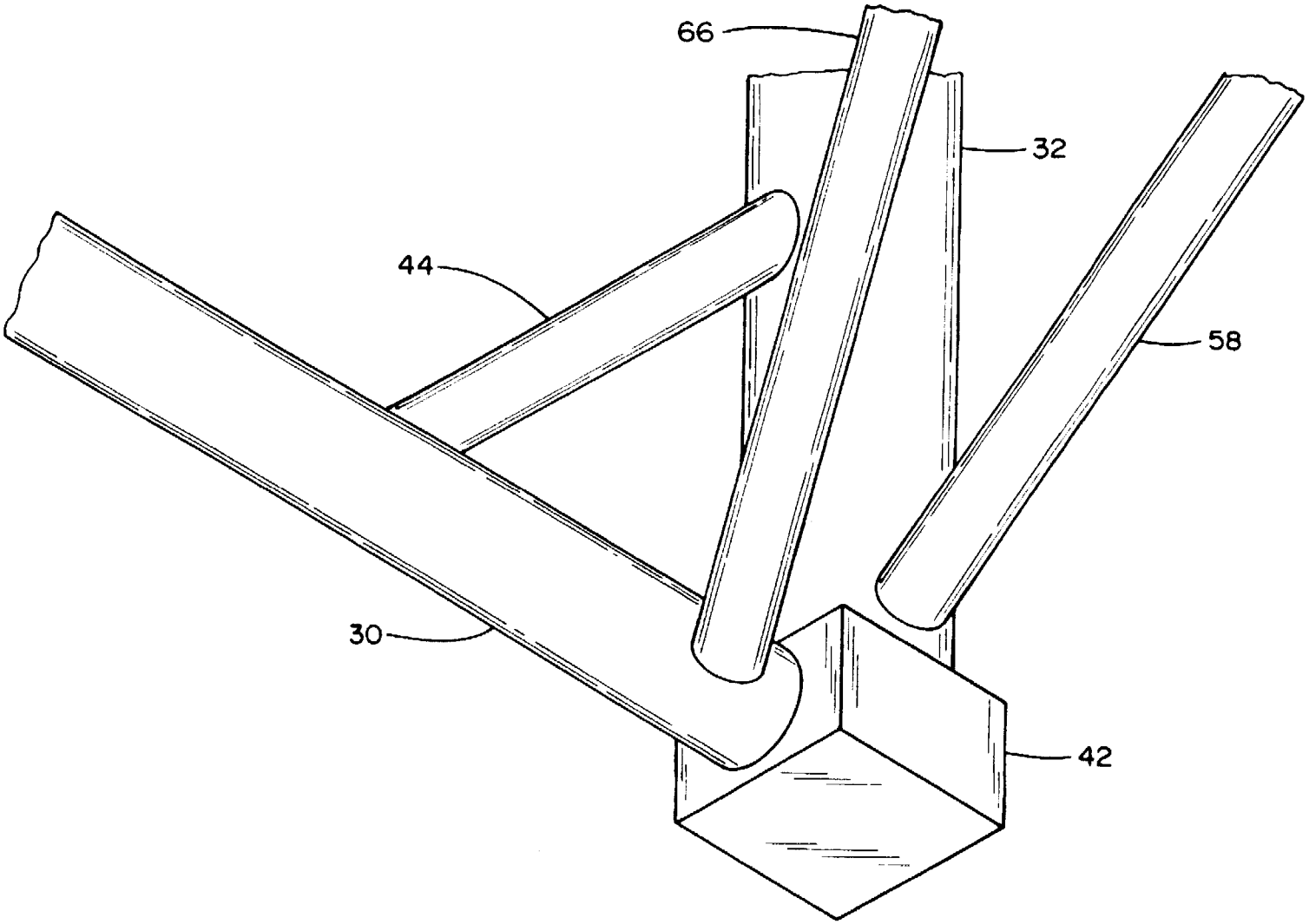
FIG. 3 is an enlarged, perspective cut-away view of the end frame and connection system shown in FIG. 2 at a lower corner fitting thereof as viewed from the tank side of the end frame.
Figure 4:
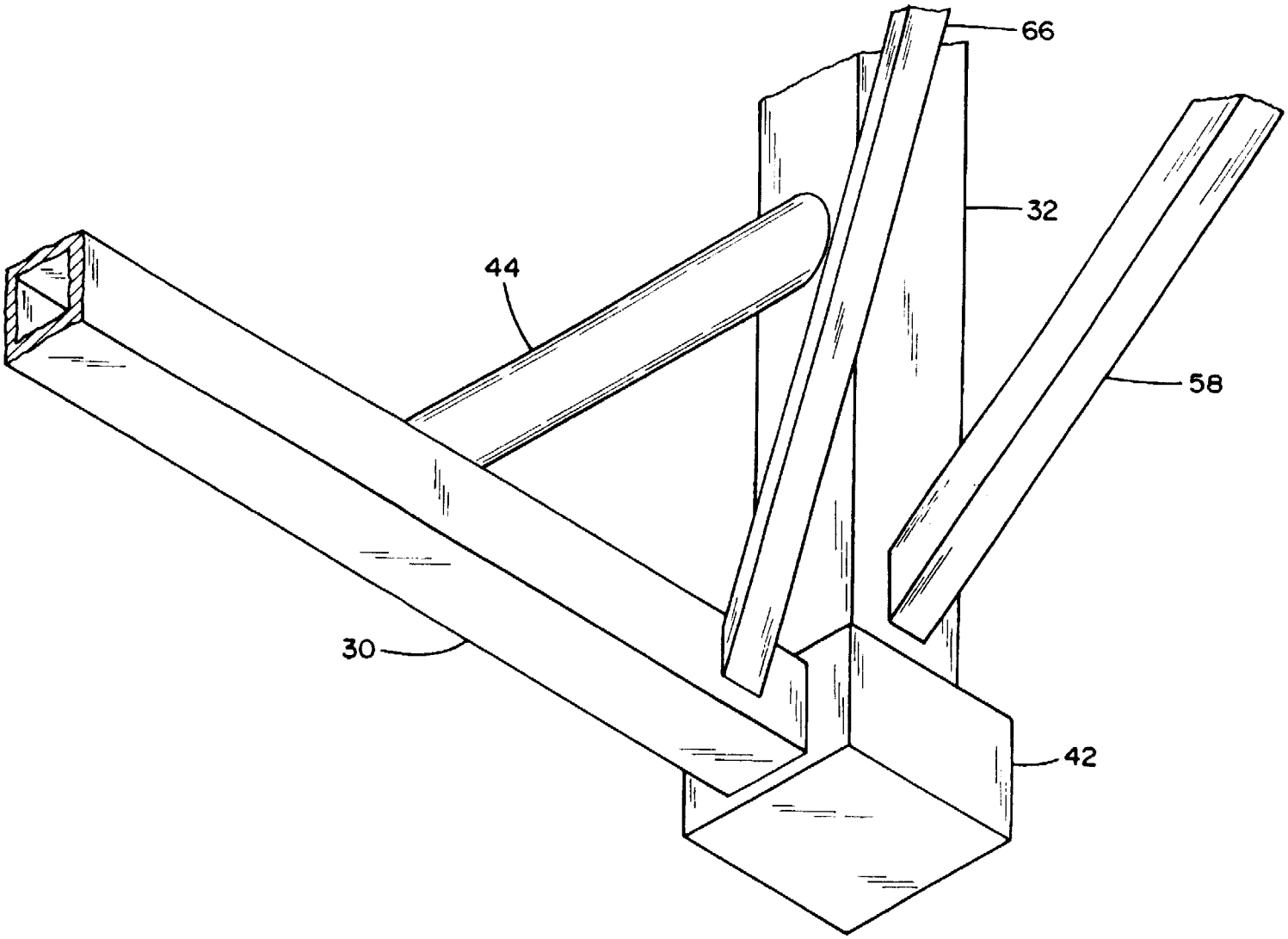
FIG. 4 is a view of the end frame and connection system as shown in FIG. 3 wherein the structural members are differently shaped.

As clearly seen in FIGS. 3 and 4, the individual truss members of trusses 46, 48, 50 and 52 may be formed of either round or rectangular pipe or tubing. Preferably, round pipe is used inasmuch as round pipe has a constant inertia throughout its length whereas the inertia is variable in rectangular pipe or tubing. In addition, torsion induces additional stresses in rectangular pipe but not in round pipe.

Figure 5:
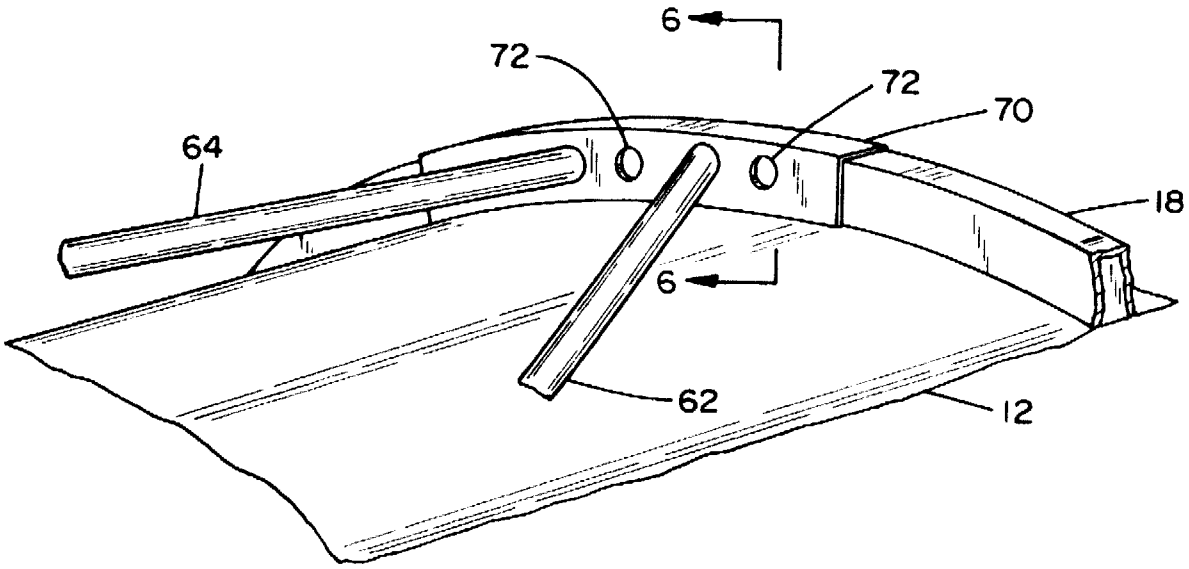
FIG. 5 is an enlarged, perspective cut-away view of the connection system of the present invention shown in FIG. 2 at the tank connection thereof.
Figure 6:
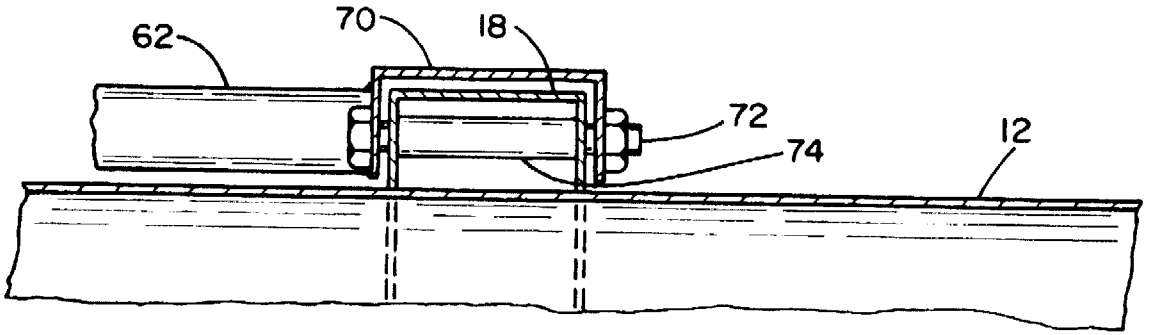
FIG. 6 is a cross-sectional view of the connection system tank connection shown in FIG. 5 taken along line 6—6 thereof.

In FIGS. 5 to 16, different methods of connecting the individual truss members to the ring stiffeners and end frames are shown. In FIGS. 5 and 6, truss members 62 and 64 of top horizontal truss 50 are welded at their ends to the side of a channel section saddle sleeve 70 which overlies ring stiffener 18. Saddle sleeve 70 is bolted to ring stiffener 18 by bolts 72 which pass through both sides of saddle sleeve 70 and the channel of ring stiffener 18. Ring stiffener 18 may be strengthened at the bolted connection by a spacer sleeve 74 disposed between the sides of ring stiffener 18 at the bolt holes through which bolt 72 passes. By bolting overlying channel 70 at both sides of ring stiffener 18, the attachment is stronger than if only one side of ring stiffener 18 were bolted.

Figure 7:
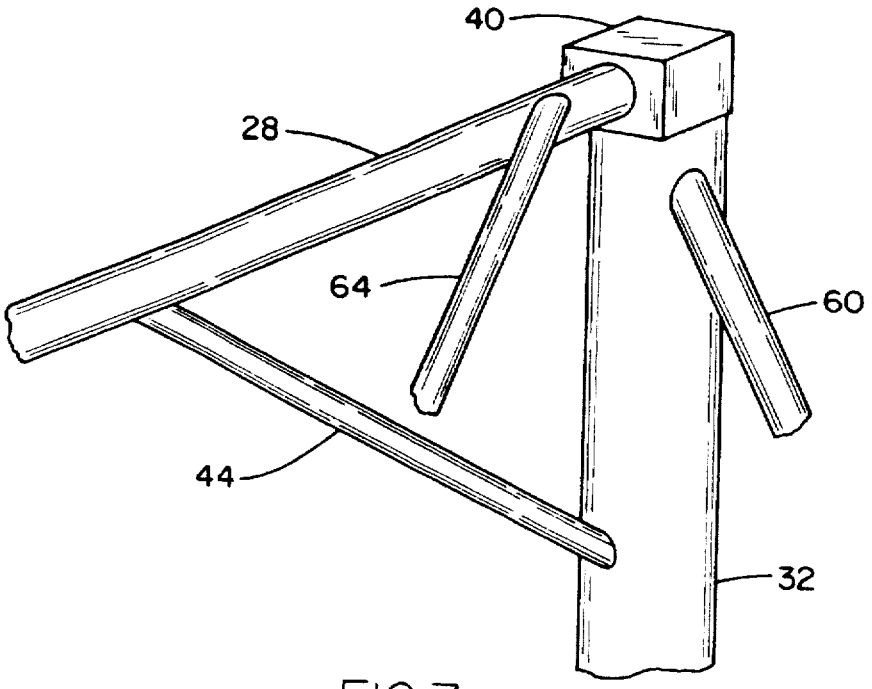
FIG. 7 is an enlarged, perspective cut-away view of the end frame and connection system shown in FIG. 2 at an upper corner fitting thereof as viewed from the tank side of the end frame.
Figure 8:
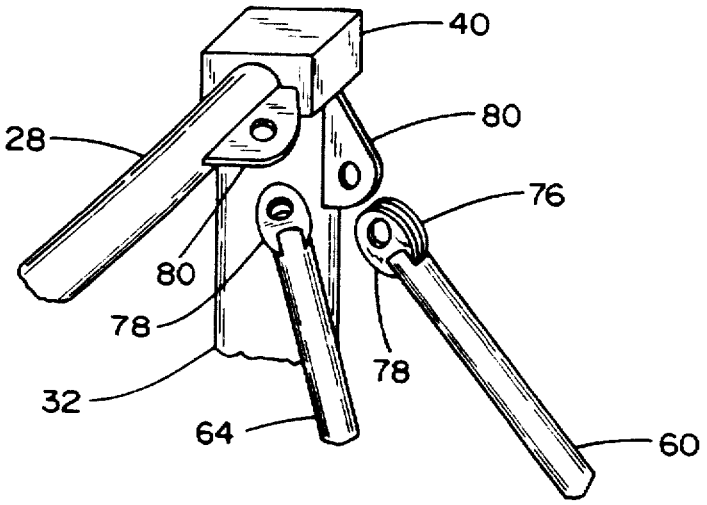
FIG. 8 is a view similar to FIG. 7 showing another method of connection of the connecting system to the end frame.
Figure 9:
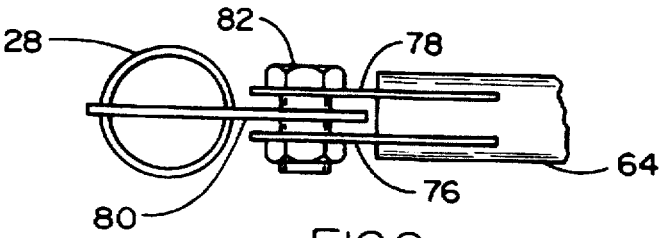
FIG. 9 is a detail view of a connection of a truss member to the end frame as shown in FIG. 8.

FIGS. 7 to 9 show two methods of attaching truss members to an end frame. In FIG. 7, truss members 60 and 64 are shown to be welded to corner post 32 and horizontal top rail 28 of end frame 14, respectively. In FIG. 8, truss members are shown to be bolted to the end frame. Bolting the truss members to the end frame has the advantage that bolting takes out most bending momemts in the truss members since the bolted connection performs like a hinge. The bolted connection allows truss members of a smaller thickness to be utilized than in the case of the welded connection. As clearly seen in FIGS. 8 and 9, the end of each truss member, for example truss members 60 and 64, has inserted therein and welded thereto a pair of parallel ears, designated 76 and 78, while the respective end frame member, for example corner post 32 and horizontal top rail 28, has a single ear 80 inserted therethrough and welded. Single ear 80 is sandwiched between forked parallel ears 76 and 78 and bolted thereto by nut and bolt 82 to form a clevis type connection.

Figure 10:
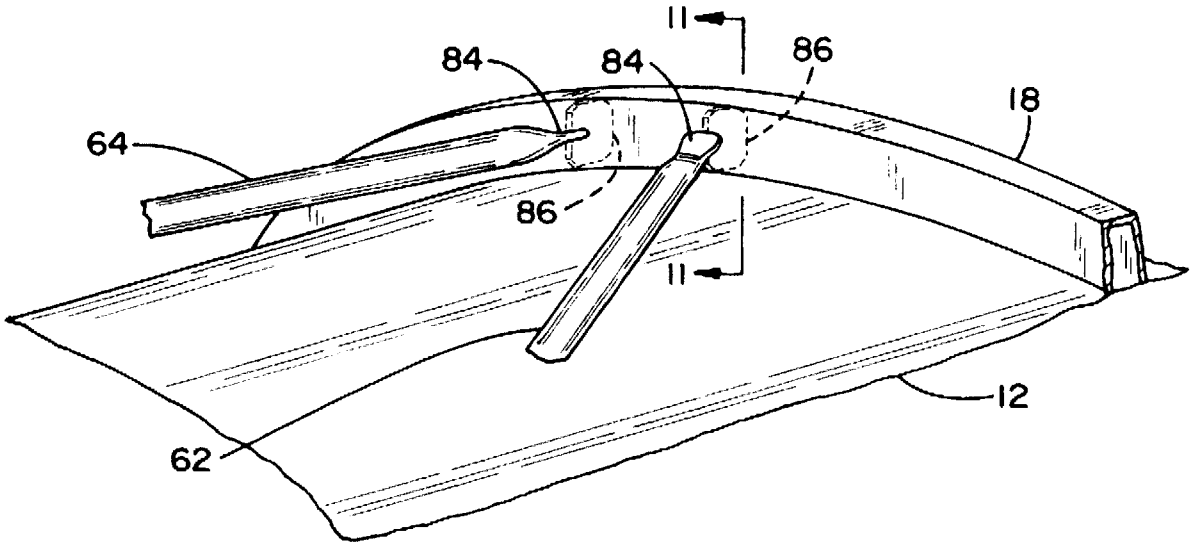
FIG. 10 is a view similar to the view of FIG. 5 showing an alternative method of connection of the connecting system to the tank.
Figure 11:
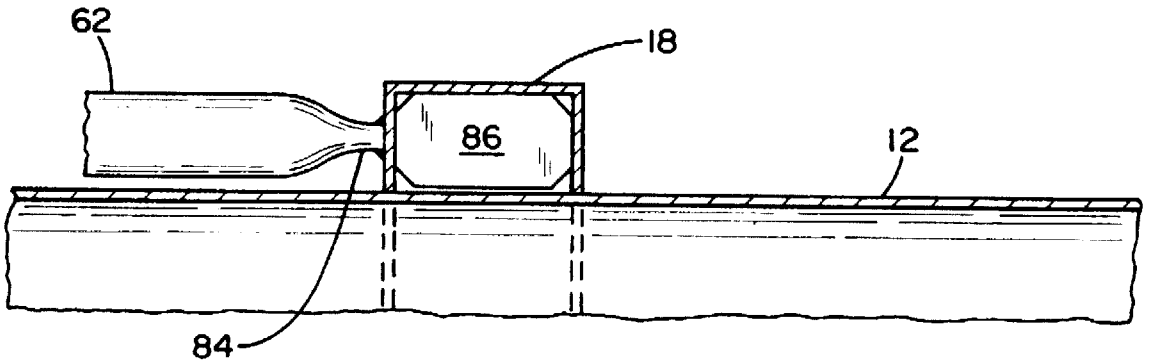
FIG. 11 is a cross-sectional view of the connection system tank connection shown in FIG. 10 taken along line 11—11 thereof.
Figure 12:
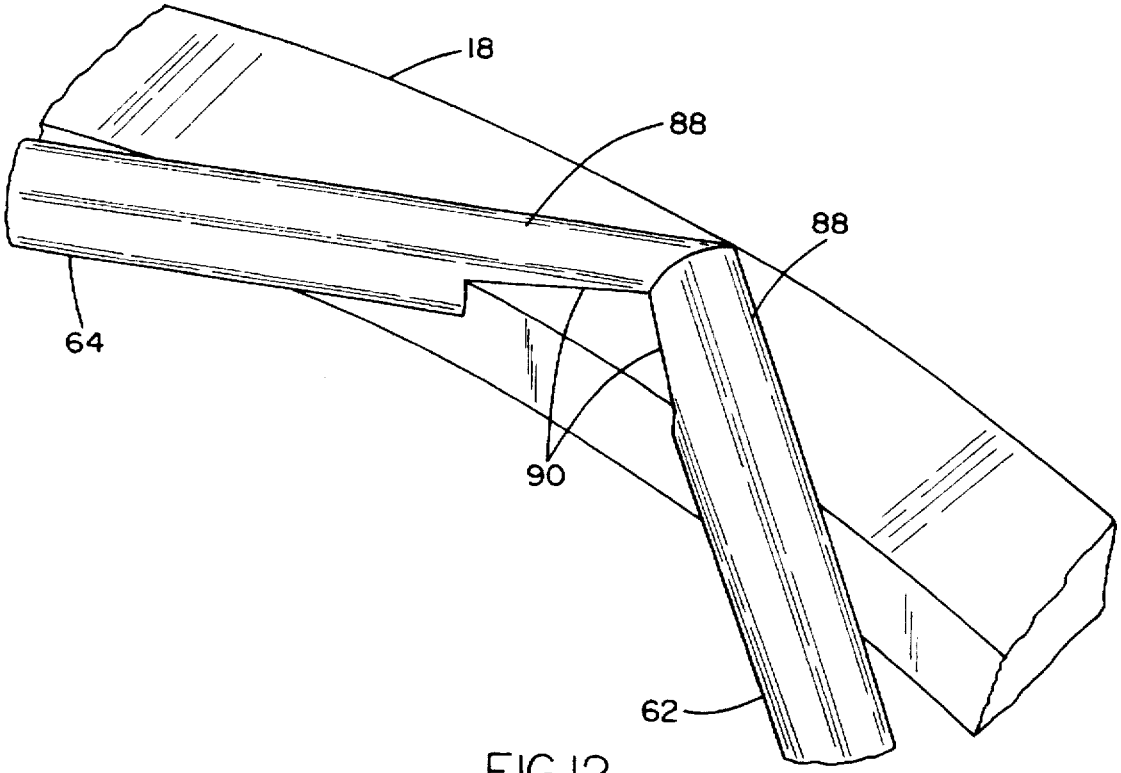
FIG. 12 is a perspective view of another alternative method of connection of the connecting system to the tank.
Figure 13:
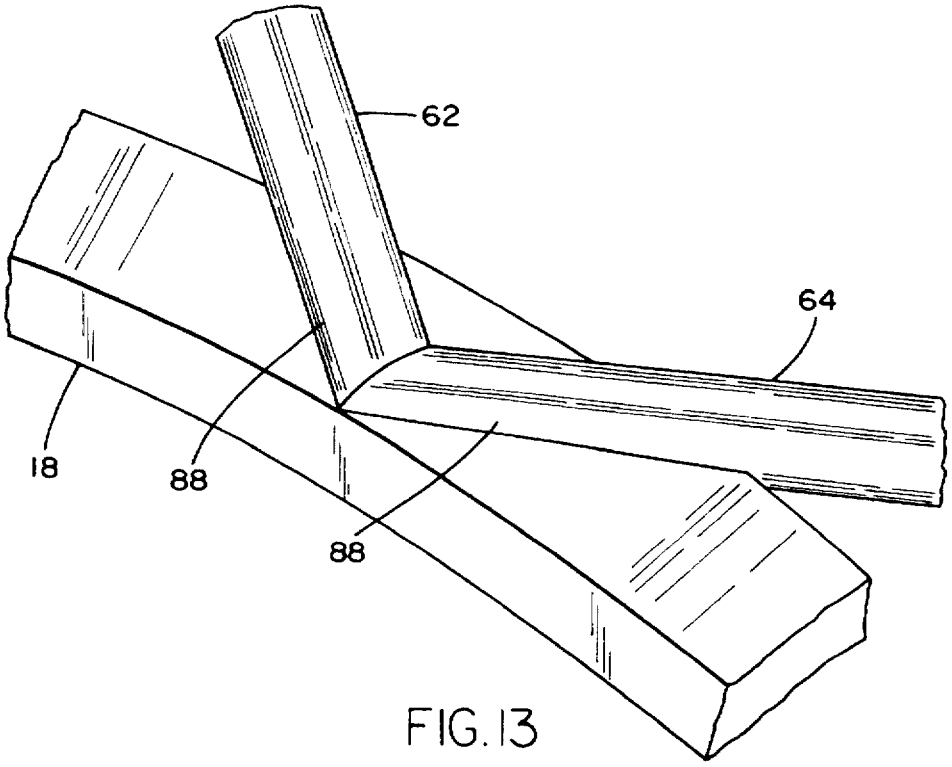
FIG. 13 is a perspective view of the connection method shown in FIG. 12 as viewed from an opposing direction.
Figure 14:
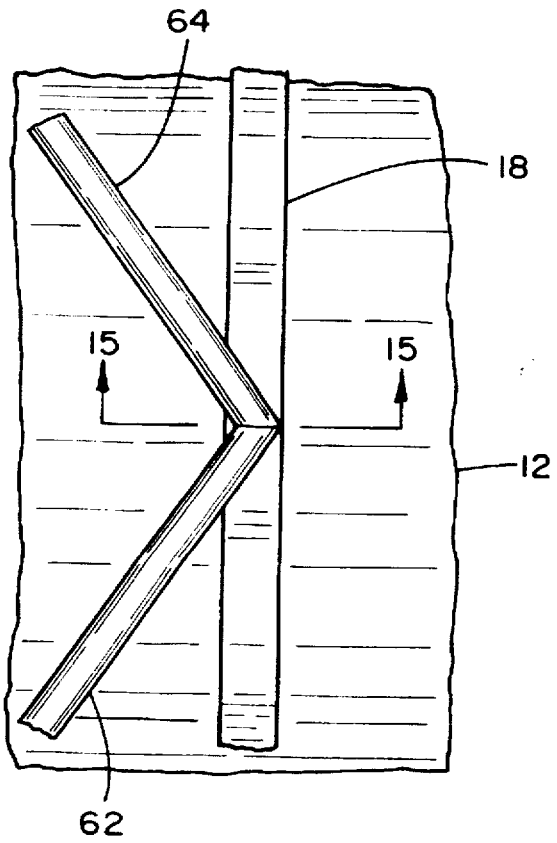
FIG. 14 is a top plan view of the connection method shown in FIG. 12.
Figure 16:
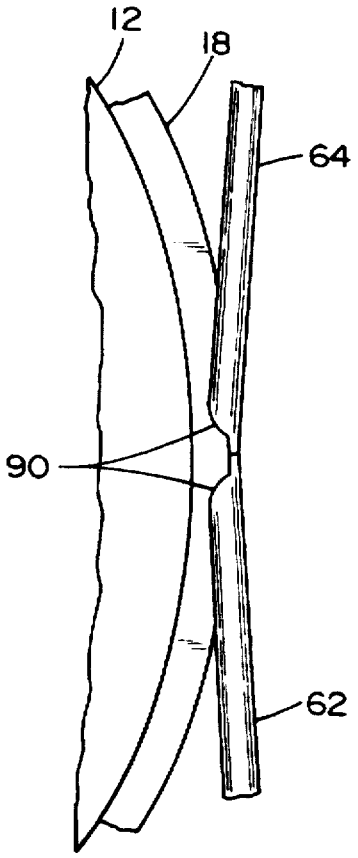
FIG. 16 is a left side view of the connection method shown in FIG. 12.
Figure 15:
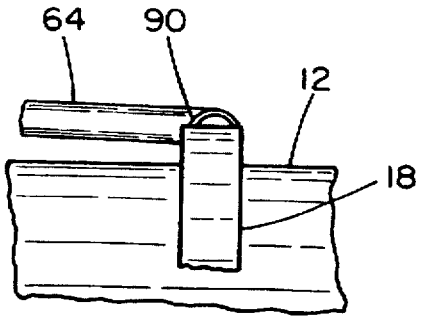
FIG. 15 is a cross-sectional view of the connection method shown in FIG. 14 taken along the line 15—15 thereof.

FIGS. 10 and 11 show another method of truss member connection to ring stiffener 18. Thus, the tank connection ends 84 of truss members 62 and 64 of top horizontal truss 50 are deformed as by flattening or tapering and the end tip welded to the side of ring stiffener 28. In order to transmit the stresses to both sides of ring stiffener 18, a connection plate 86 is welded on the inside of the channel structure of ring stiffener 18 at the point of connection of the truss member.

FIGS. 12 to 16 show another example of a truss member to ring stiffener 18 connection method. In this connection method, the tank connection ends 88 of truss members 62 and 64 of top horizontal truss 50 are partially cut-out at 90 to overlap ring stiffener 18 and welded thereto. As clearly seen, the ends 88 of truss members 62 and 64 are adapted to meet and are welded together as well as to ring stiffener 18 for greater strength. Alternatively, the ends 88 of the truss members may be spaced from each other and welded to ring stiffener 18.

Figure 17:
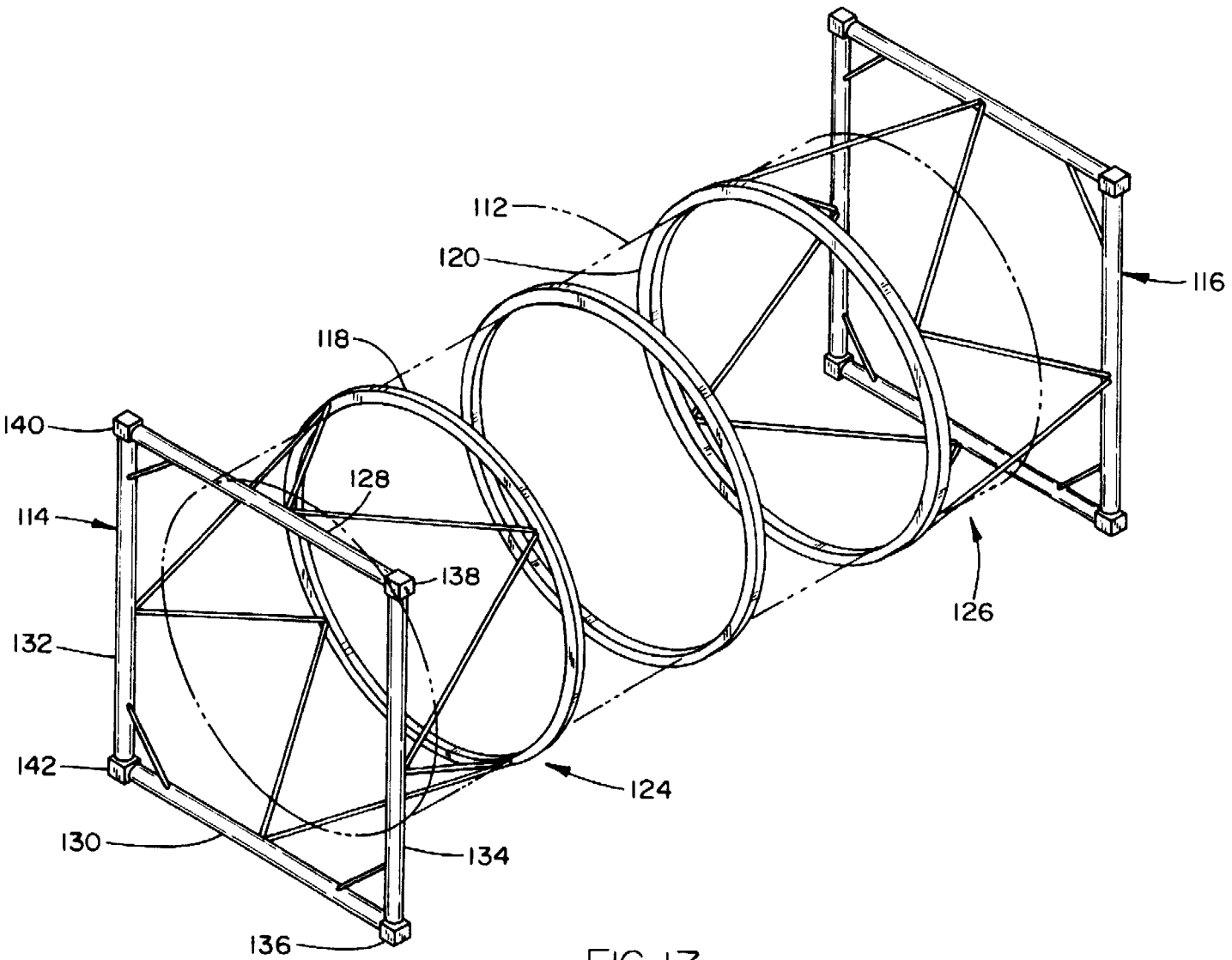
FIG. 17 is a view similar to that of FIG. 1 showing a second embodiment of tank to end frame connection system.
Figure 18:
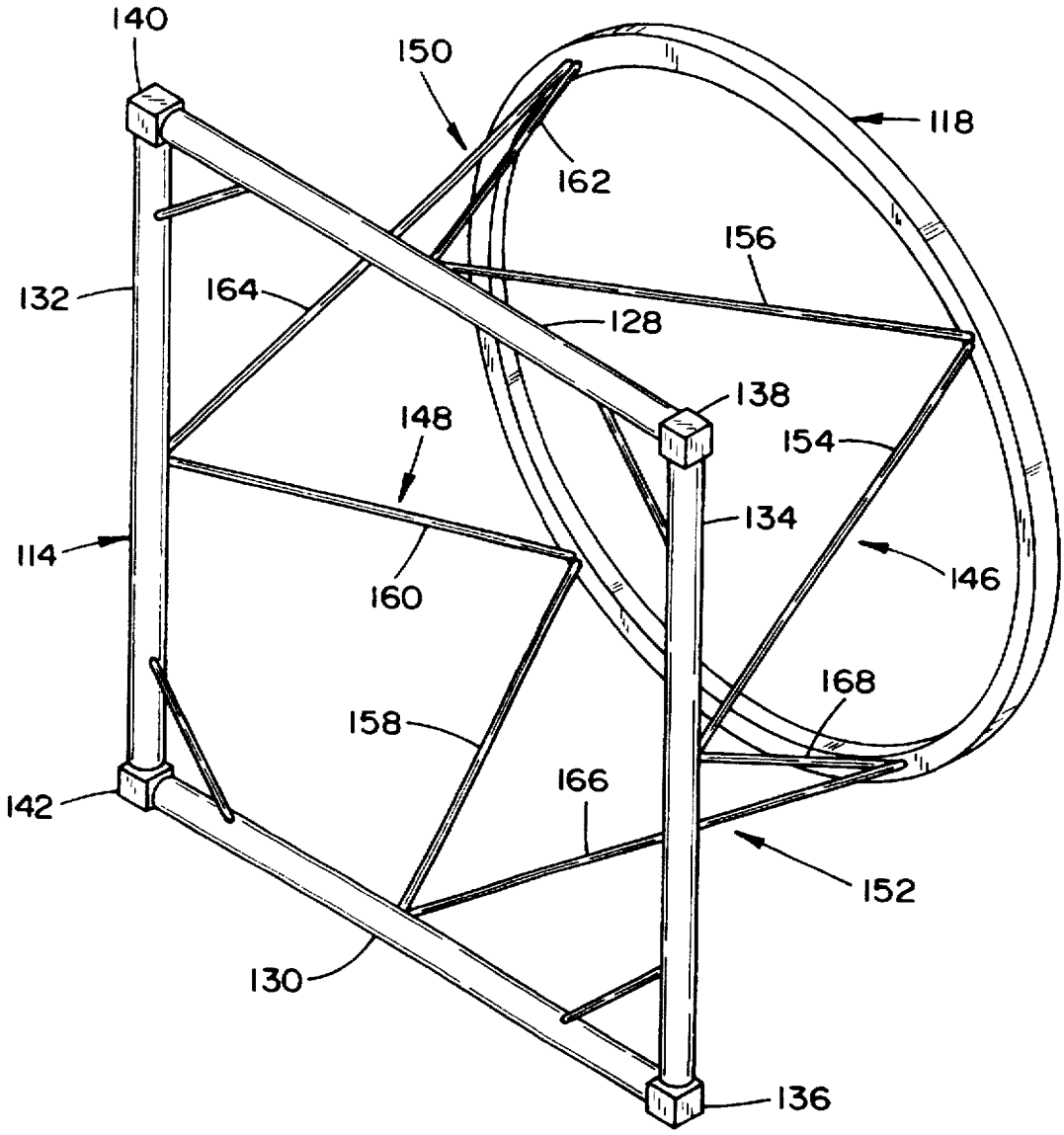
FIG. 18 is a perspective view of one of the intermodal container tank structural end frames and tank to end frame connection system of the embodiment of FIG. 17.

FIG. 17 shows a second embodiment of the tank to end frame connecting system of the present invention. Therein, tank vessel 112 provided with rear circumferential stiffening ring 118 and front circumferential stiffening ring 120 is connected to rear end frame 114 and front end frame 116 by rear connecting system 124 and front connecting system 126, respectively. Rear connecting system 124 is substantially identical to front connecting system 126 and, as clearly seen in FIG. 18, its four trusses 146, 148, 150 and 152 are connected to rear stiffening ring 118 at points which are 45° to the horizontal and vertical diametric planes of tank vessel 112. Truss members 154 and 156 of truss 146 extend from their common connection at ring stiffener 118 at substantially 45° to each other to the center point of right corner post 134 and the center point of horizontal top rail 128, respectively, of end frame 114. Thus, the adjacent one half sections of right corner post 134 and horizontal top rail 128 together form a truss member of truss 146. Similarly, truss members 158 and 160 of truss 148 extend from their common connection at stiffening ring 118 to the center points of horizontal bottom rail 130 and left corner post 132, respectively. Truss members 162 and 164 of truss 150 extend from their common connection at stiffening ring 118 to the center points of horizontal top rail 128 and left corner post 132, respectively. Truss members 166 and 168 of truss 152 extend from their common connection at stiffening ring 118 to the center points of horizontal bottom rail 130 and right corner post 134, respectively. Connecting systems 124 and 126, connecting end frames 114 and 116 to circumferential ring stiffeners 118 and 120, respectively, effectively transfers all horizontal and vertical tank loads to the horizontal rails and corner posts of the end frames and thus the corner fittings which support the intermodal container tank during shipping and handling.

Although the above general and detailed descriptions relate the present invention to use with a beam type intermodal container tank, it is possible to utilize the same with the full frame type intermodal container tank wherein longitudinal beams connect the corner fittings of the front and rear end frames. It is also possible to strengthen the beam type intermodal container tank utilizing the present invention by the addition of longitudinal braces connected between the end ring stiffeners and the intermediate ring stiffeners. Such braces are attached to the end ring stiffeners at about the connection thereto of the vertical and horizontal trusses.

It is to be understood that the foregoing general and detailed descriptions are explanatory of the present invention and are not to be construed as restrictive of the scope of the following claims.

What is claimed is:

1. In an intermodal container tank including a substantially cylindrically shaped tank vessel, a circumferential ring stiffener circumferentially surrounding said tank vessel at a front end of said tank vessel, a circumferential ring stiffener circumferentially surrounding said tank vessel at a rear end of said tank vessel, a front structural end frame supporting the front end of said tank vessel, and a rear structural end frame supporting the rear end of said tank vessel, each of said end frames including top and bottom horizontal rails, left and right corner posts, and four corner fittings, the improvement comprising:

a connecting system connecting said front structural end frame to the front end of said tank vessel and a connecting system connecting said rear structural end frame to the rear end of said tank vessel, wherein each said connecting system comprises a left and right side vertical truss connecting the left and right corner posts of the respective end frame to the left and right lateral sides of the respective circumferential ring stiffener, and a top and bottom horizontal truss connecting the top and bottom horizontal rails of the respective end frame to the top and bottom of the respective circumferential ring stiffener.

2. The intermodal container tank as defined in claim 1, wherein each vertical truss comprises a pair of truss members connected to the corner post at the respective side of the respective end frame at a top and bottom thereof near the respective top and bottom corner fittings and extending from said corner post downwardly and upwardly approximately 45° to the respective lateral side of the respective circumferential ring stiffener, and each horizontal truss comprises a pair of truss members connected to the horizontal rail of the respective top and bottom of the respective end frame at a left and right side thereof near the respective corner fittings and extending from said horizontal rail at approximately 45° to the respective top and bottom of the respective ring stiffener.

3. The intermodal container tank as defined in claim 2, wherein the truss members connected to said corner posts and said top and bottom horizontal rails of said end frames are welded thereto.

4. The intermodal container tank as defined in claim 3, wherein the forked members of the clevis type bolted connections are formed on the truss members connected to said corner posts and horizontal rails.

5. The intermodal container tank as defined in claim 2, wherein the truss members connected to said corner posts and said top and bottom horizontal rails of aid end frames are bolted thereto.

6. The intermodal container tank as defined in claim 5, wherein the bolted connections of said truss members to the corner posts and horizontal rails of said end frames are clevis type bolted connections.

7. The intermodal container tank as defined in claim 6, wherein the connection of each pair of truss members of the vertical and horizontal trusses to the respective ring stiffener comprises a saddle sleeve to which the ends of the truss members are welded, said saddle sleeve overlying said ring stiffener and being through bolted thereto.

8. The intermodal container tank as defined in claim 2, wherein each pair of truss members of the vertical and horizontal trusses are connected to the respective ring stiffener by welded connection and a laterally extending connection support plate connecting the sides of said ring stiffener is welded at the inside of said ring stiffener at each said truss member connection.

9. The intermodal container tank as defined in claim 2, wherein the connection of each pair of truss members of the vertical and horizontal trusses to the respective ring stiffener comprises forming the ends of the respective truss members to overlie at least a portion of the longitudinal side of said ring stiffener and the longitudinal top thereof and welding the mating portions of said truss members and said ring stiffeners.

10. The intermodal container tank as defined in claim 2, wherein the truss members of said vertical and horizontal trusses are formed of rectangular tubular material.

11. The intermodal container tank as defined in claim 2, wherein the truss members of said vertical and horizontal trusses and the corner posts and horizontal rails of said end frames are formed of rectangular tubular material.

12. The intermodal container tank as defined in claim 2, wherein the truss members of aid vertical and horizontal trusses are formed of round tubular material.

13. The intermodal container tank as defined in claim 2, wherein the truss members of said vertical and horizontal trusses and the corner posts and horizontal rails of said end frames are formed of round tubular material.

14. An intermodal container tank, comprising:

a) a substantially cylindrically shaped tank vessel;

b) a plurality of circumferential ring stiffeners circumferentially surrounding said tank vessel including at least a ring stiffener at a front end of said tank vessel and a ring stiffener at a rear end of said tank vessel;

c) a front and a rear structural end frame for supporting said tank vessel arranged at the respective front and rear of said tank vessel each including top and bottom horizontal rails, left and right corner posts, and four corner fittings; and d) a connecting system connecting each of said front and rear structural end frames to said tank vessel, each connecting system comprising a left and right side vertical truss connecting the left and right corner posts of the respective end frame to the left and right lateral sides of the respective circumferential ring stiffener, and a top and bottom horizontal truss connecting the top and bottom horizontal rails of the respective end frame to the top and bottom of the respective circumferential ring stiffener.

15. The intermodal container tank as defined in claim 14, wherein each vertical truss comprises a pair of truss members connected to the corner post at the respective side of the respective end frame at a top and bottom thereof near the respective top and bottom corner fittings and extending from said corner post downwardly and upwardly approximately 45° to the respective lateral side of the respective circumferential ring stiffener, and each horizontal truss comprises a pair of truss members connected to the horizontal rail of the respective top and bottom of the respective end frame at a left and right side thereof near the respective corner fittings and extending from said horizontal rail at approximately 45° to the respective top and bottom of the respective ring stiffener.

16. The intermodal container tank as defined in claim 15, wherein the truss members connected to said corner posts and said top and bottom horizontal rails of said end frames are welded thereto.

17. The intermodal container tank as defined in claim 15, wherein the truss members connected to said corner posts and said top and bottom horizontal rails of said end frames are bolted thereto.

18. The intermodal container tank as defined in claim 17, wherein the bolted connections of said truss members to the corner posts and horizontal rails of said end frames are clevis type bolted connections.

19. The intermodal container tank as defined in claim 18, wherein the forked members of the clevis type bolted connections are formed on the truss members connected to said corner posts and horizontal rails.

20. The intermodal container tank as defined in claim 15, wherein the connection of each pair of truss members of the vertical and horizontal trusses to the respective ring stiffener comprises a saddle sleeve to which the ends of the truss members are welded, said saddle sleeve overlying said ring stiffener and being through bolted thereto.

21. The intermodal container tank as defined in claim 15, wherein each pair of truss members of the vertical and horizontal trusses are connected to the respective ring stiffener by welded connection and a laterally extending connection support plate connecting the sides of said ring stiffener is welded at the inside of said ring stiffener at each said truss member connection.

22. The intermodal container tank as defined in claim 15, wherein the connection of each pair of truss members of the vertical and horizontal trusses to the respective ring stiffener comprises forming the ends of the respective truss members to overlie at least a portion of the longitudinal side of said ring stiffener and the longitudinal top thereof and welding the mating portions of said truss members and said ring stiffeners.

23. The intermodal container tank as defined in claim 15, wherein the truss members of said vertical and horizontal trusses are formed of rectangular tubular material.

24. The intermodal container tank as defined in claim 15, wherein the truss members of said vertical and horizontal trusses and the corner posts and horizontal rails of said end frames are formed of rectangular tubular material.

25. The intermodal container tank as defined in claim 15, wherein the truss members of said vertical and horizontal trusses are formed of round tubular material.

26. The intermodal container tank as defined in claim 15, wherein the truss members of said vertical and horizontal trusses and the corner posts and horizontal rails of said end frames are formed of round tubular material.

27. In an intermodal container tank including a substantially cylindrically shaped tank vessel, a circumferential ring stiffener circumferentially surrounding said tank vessel at a front end of said tank vessel, a circumferential ring stiffener circumferentially surrounding said tank vessel at a rear end of said tank vessel, a front structural end frame supporting the front end of said tank vessel, and a rear structural end frame supporting the rear end of said tank vessel, each of said end frames including top and bottom horizontal rails, left and right corner posts, and four corner fittings, the improvement comprising:

a connecting system connecting said front structural end frame to the front end of said tank vessel and a connecting system connecting said rear structural end frame to the rear end of said tank vessel, wherein each said connecting system comprises eight truss members arranged in pairs circumscribing the respective ring stiffener, each pair of truss members being connected to said ring stiffener at a common point at 45° from the horizontal and vertical diametric planes of said tank vessel.

28. The intermodal container tank as defined in claim 27, wherein said each pair of truss members extend from said ring stiffener at approximately 45° to each other to connect at the center point of an adjacent horizontal rail and corner post.

29. An intermodal container tank, comprising:

a) a substantially cylindrically shaped tank vessel;

b) a plurality of circumferential ring stiffeners circumferentially surrounding said tank vessel including at least a ring stiffener at a front end of said tank vessel and a ring stiffener at a rear end of said tank vessel;

c) a front and a rear structural end frame for supporting said tank vessel arranged at the respective front and rear of said tank vessel each including top and bottom horizontal rails, left and right corner posts, and four corner fittings; and d) a connecting system connecting each of said front and rear structural end frames to said tank vessel, each connecting system comprising eight truss members arranged in pairs circumscribing the respective ring stiffener, each pair of truss members being connected to said ring stiffener at a common point at 45° from the horizontal and vertical diametric planes of said tank vessel.

30. The intermodal container tank as defined in claim 29, wherein said each pair of truss members extend from said ring stiffener at approximately 45° to each other to connect at the center point of an adjacent horizontal rail and corner post.

* * * * *